US005816043A

United States Patent [19]

Wolf et al.

[11] Patent Number: 5,816,043

[45] Date of Patent: Oct. 6, 1998

[54] SHIELD ENCOMPASSING A HOT PIPE

[75] Inventors: Jerry M. Wolf, Powell; Hiten T. Shah, Delaware, both of Ohio

[73] Assignee: Acoust-A-Fiber Research and Development, Inc., Delaware, Ohio

[21] Appl. No.: 582,146

[22] Filed: Jan. 2, 1996

[51] Int. Cl.[6] ..... F01N 7/10; F01N 7/14

[52] U.S. Cl. ..... 60/272; 60/323; 138/149

[58] Field of Search ..... 60/272, 323; 138/147, 138/148, 149, 151

[56] References Cited

U.S. PATENT DOCUMENTS

| | | | |
|---|---|---|---|
| 1,613,725 | 1/1927 | Sabin | 138/149 |
| 1,618,455 | 2/1927 | Lindsay | 138/149 |
| 3,886,981 | 6/1975 | Eliason | 138/149 |
| 3,955,601 | 5/1976 | Plummer | 138/149 |
| 4,022,019 | 5/1977 | Garcea | 60/323 |
| 4,182,122 | 1/1980 | Stratton et al. | 60/322 |
| 4,612,767 | 9/1986 | Engquist et al. | 60/323 |
| 4,914,912 | 4/1990 | Akatsuka | 60/323 |
| 5,092,122 | 3/1992 | Bainbridge | 60/272 |
| 5,233,832 | 8/1993 | Moore | 60/323 |

FOREIGN PATENT DOCUMENTS

| | | | |
|---|---|---|---|
| 153916 | 9/1984 | Japan | 60/272 |

*Primary Examiner*—Douglas Hart
*Attorney, Agent, or Firm*—Sidney W. Millard; Kremblas, Foster, Millard & Pollick

[57] ABSTRACT

A hot pipe from an automobile manifold is shielded from other components in the engine compartment by attaching a two part shield around the pipe and clamping it in place. Each part is formed of two sheets of metallic material sandwiching therebetween a fibrous layer of heat insulating material. The layers of each of the shield parts are formed to a shape to conform to the shape of the hot pipe to be shielded prior to installation.

17 Claims, 4 Drawing Sheets

SHIELD ENCOMPASSING A HOT PIPE

FIELD OF THE INVENTION

This invention relates to a shield to be mounted around a hot pipe to shield other components in the vicinity of the pipe from heat radiation.

BACKGROUND OF THE INVENTION

High performance engines used in modern vehicles tend to operate at a higher temperature than internal combustion engines of several years ago. As a result, the temperature of the exhaust manifold and other component parts rises to a level where the components may be "red hot". The problem this creates is that operating apparatus within the engine compartment having rubber, plastic or other non-metal components may be subjected to excessive and undesirable radiant heat from the hot body and thereby prematurely deteriorate the non-metal components. Examples of operating apparatus having non-metal components which fall into this category are alternators, starter motors, turbo chargers, and plastic storage containers for water and brake cylinder reservoirs.

There is a need to provide a heat shield or heat barrier between the hot body and the operating apparatus which is structured in a way to minimize heat build up in the operating apparatus as a result of radiant heat from the hot body.

A patent to Garcea, U.S. Pat. No. 4,022,019 discloses an exhaust system for an internal combustion engine with a heat shield as illustrated in FIG. 1. The shield comprises a corrugated stainless steel tube 6 clamped to the exhaust pipe 1 by a clamp 8. The insulating feature is the air pocket 11.

A patent to Engquist et al, U.S. Pat. No. 4,612,767 discloses a two layer heat shield around an exhaust manifold 16 which uses convection between the two layers 22, 42 to minimize heat radiation from manifold 16. Openings 52, 54 through the shield layers allow air to circulate from the outside to the spaces between the manifold and the two covering layers.

A patent to Akatsuka, U.S. Pat. No. 4,914,912 is somewhat difficult to read but what it has is a pair of metallic elements 8, 10 sandwiching therebetween an insulating layer 6 secured over the surface of an exhaust manifold 2. Note the transversely extending flanges at the edges of the insulating panel 4.

A patent to Moore, U.S. Pat. No. 5,233,832 illustrates a laminated heat shield made purely of metallic components and one is identified as aluminum.

A patent to Stratton et al, U.S. Pat. No. 4,182,122 discloses an insulated exhaust manifold where the insulation system is molded or cast to size, severed in two 56, 58 and then assembled over the pipe to be shielded. The disclosed system for mounting the two halves in place is by a wrapping 30.

What is needed is a heat shield structured to conform to the surface of a hot pipe to be shielded and the shield structured so that it is easily mounted or removed from the pipe when the need arises. Prior art described above and to the extent known provides certain heat shielding but it is difficult to use in assembly or disassembly when maintenance work is required on the manifold or whatever hot pipe is being shielded.

SUMMARY OF THE INVENTION

This invention solves the problem by providing a heat shield comprising two parts which may or may not be mirror images of each other which fit together around a pipe and are clamped in place to prevent longitudinal movement with respect to each other.

Each of the two parts of the shield is formed to encompass about half of the pipe to be shielded and consists of three layers. Two layers comprise metal foil, either stainless steel or aluminum foil and sandwiched between the two layers of metal is a fibrous bat of insulating material. The fibrous bat may be formed from fibers of fiberglass, basalt mineral, ceramic or mixtures of those fibers, depending upon the temperature involved. Indeed the kind of metal sheets used also depends upon the temperature involved because aluminum melts at a lower temperature than stainless steel.

In the formation of the shield components, it will be clear that the metal sheet formed to be closest to the metal pipe to be shielded is of a smaller size than the sheets spaced radially outward therefrom. For example, if the pipes should be circular, the innermost metal sheet has a smaller radius than the outer metal sheet. The outer metal sheet is formed with a larger radius to accommodate the intermediate insulating layer.

In order to maintain the metal sheets in their deformed condition encompassing the hot pipe, a flange is provided along each edge. The strengthening effect of the flange maintains the composite shield in its desired shape and minimizes its deformation during assembly and disassembly in operative locations.

In order to maintain a proper spacing of the metallic sheets in their formed condition to prevent them crushing the fibrous layer, the outermost or larger sheet has its flange bent back double between the two metallic sheets to serve as a spacer between the sheets at least as thick as the thickness of the metallic sheet itself. In the preferred embodiment, in order to maintain the two metallic sheets together they are spot welded along their flanges including the folded back portion of the outermost flange. Alternatively, they could be hemmed.

At each end of the insulating parts a circumferentially extending groove or indentation is made inwardly in the metal sheets so that the ends of the parts engage the surface of the hot pipes but serve to space the bridging portion between the indentations of the insulation element spaced from the hot surface of the pipe. The resulting air pocket serves as a further heat barrier to minimize heat conduction from the pipe to the insulating parts.

To keep the insulating parts from shifting longitudinally on the pipe relative to each other, a slot is cut through each flange aligned with the aforementioned indentation so that a strap may encircle the two mating insulation elements and maintain them in proper orientation. The strap fits down into the groove formed to space the elements from the hot pipe and extends through the slot in each flange. Its ends are buckled or otherwise secured together to maintain the insulating parts in place. Bolts or other well-known clamping mechanisms may be used to secure the insulation parts together but in this preferred embodiment a fibrous, metal or reinforced plastic strap is used so that it may be severed easily or perhaps undone to allow quick and easy disassembly of the insulation components if such is needed.

Objects of the invention not clear from the above will be fully appreciated upon a review of the drawings and the description of the preferred embodiments which follow.

DESCRIPTION OF THE PREFERRED EMBODIMENTS

In the environment engine compartment of modern vehicles, the exhaust manifold receiving hot gases from the internal combustion engine runs red hot on occasion. By way of example, exhaust manifolds in such modern vehicles often run at a temperature of 1600° F. This is a problem in engine compartments because the surface of the hot exhaust system radiates heat in all directions and may tend to deteriorate the plastic and fibrous parts used in alternators, starter motors, turbo chargers and the like.

There are two or more ways to minimize the heat radiation problem. One is to shield the component which is subject to deterioration and this is accomplished by mounting a heat shield on the starter motor, etc. between the hot exhaust manifold and the surface of the component to be protected. Another mechanism is to provide a heat shield on the surface of the hot manifold. It is quite clear that both shielding mechanisms may be used at the discretion of the user. This invention is directed primarily toward insulation components to be applied over the surface of the hot body, in this case the legs of the manifold discharging hot gases from the internal combustion engine.

Figure 1:
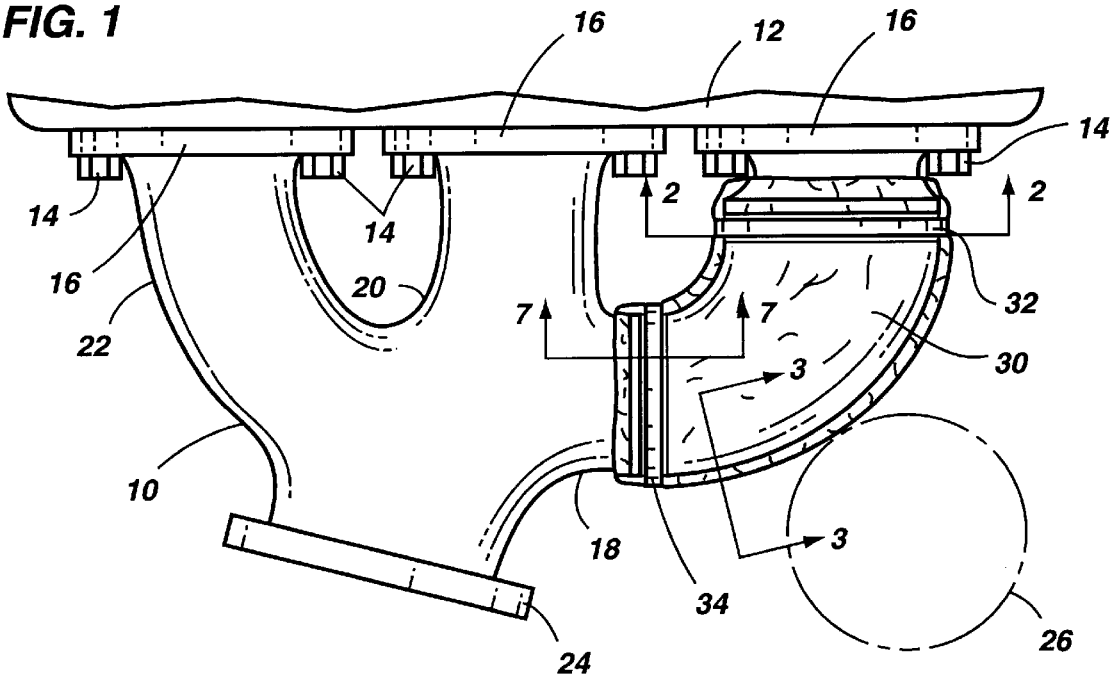
FIG. 1 is a fragmentary plan view of an exhaust manifold of an automobile engine with an insulating unit mounted on one leg of the manifold in accordance with this invention.

Looking to FIG. 1, an exhaust manifold 10 is secured to the block 12 of an internal combustion engine by a set of cap screws 14 projecting through holes in flanges 16 and threaded into holes in the block.

The manifold 10 may have any number of legs and in is this case it has three legs 18, 20, 22. Hot gases exiting the block 12 through the legs 18, 20, 22 pass on to the exhaust system (not shown) which is secured to the manifold at outlet flange 24.

Figure 4A:
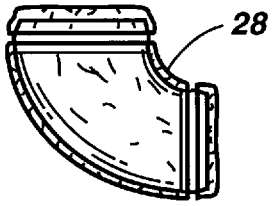
FIGS. 4A & 4B illustrate two mating shapes which may be used as shields according to this invention.
Figure 4B:
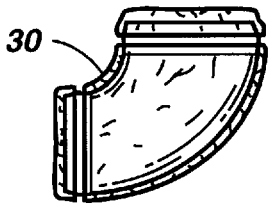
Figure 5A:
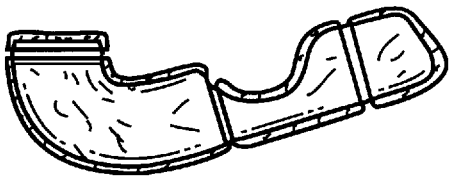
FIGS. 5A and 5B show an alternate set of mating insulation parts which may be fitted over the exterior surface of hot pipes according to this invention.
Figure 5B:
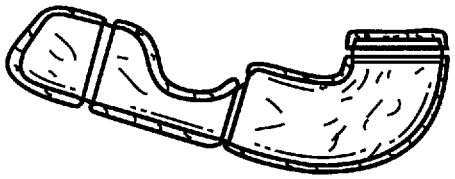
Figure 6A:
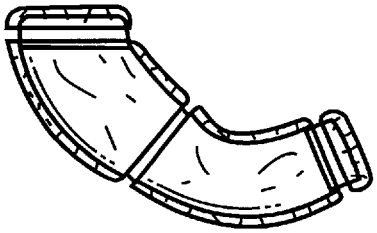
FIGS. 6A and 6B show an alternative structure for mating insulation parts where the assembly does not allow the parts to be mirror images of each other as they are in FIGS. 4A–4B and 5A–5B.
Figure 6B:
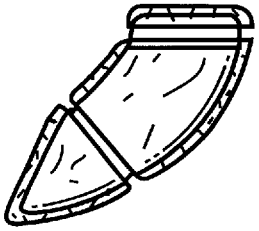

In order to shield some operating component 26 within the engine compartment from the radiation of the hot surface of the manifold 10, a set of insulation parts are mounted on legs 18, 20, 22. Only leg 18 is shown with the insulation elements mounted in place. The general shape of the two mating components forming the insulation are illustrated in FIGS. 4A and 4B. In this case the two insulation elements or parts 28, 30 are mirror images of each other and are secured together by straps 32, 34 which will be described in more detail subsequently. In operative position parts 28, 30 form a tube to encircle leg 18.

In forming the insulation elements 28, 30, each includes a smaller or inner metal sheet 36 of aluminum foil or stainless steel spaced from a larger or outer metal sheet 38 of the same composition. Sandwiched between the sheets 36, 38 is a layer of insulating material 40. A wide variety of insulating materials may be suitable in various environments depending upon the degree of temperature drop across the composite part from the hot surface to the exterior metal sheet 38. In the preferred embodiment, operating in the intended locations of this invention, the insulating material may be fibrous in nature, such as fiberglass, basalt mineral fiber, ceramic fiber and mixtures thereof, at the discretion of the manufacturer. It is clear that some of the fibers are more expensive than others and the expense of the best insulating fiber may be inappropriate for economic reasons under certain conditions.

Figure 2:
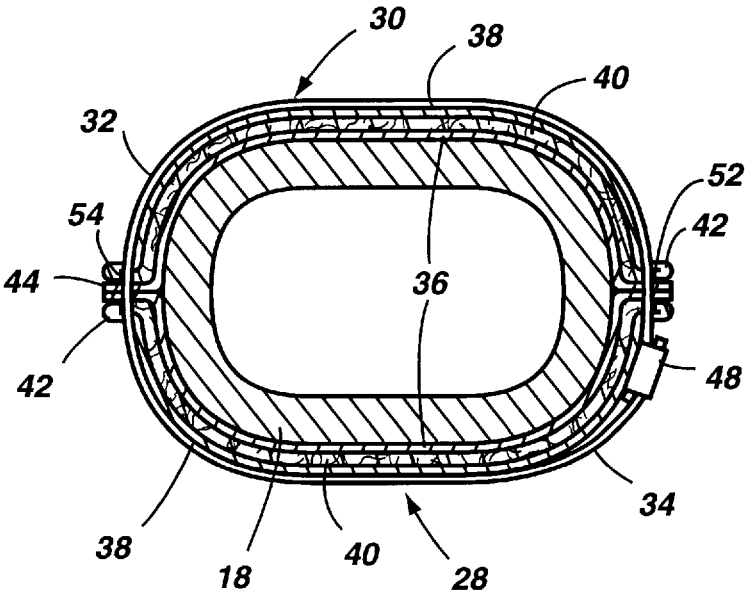
FIG. 2 is a sectional view taken along line 2—2 of FIG. 1.
Figure 3:
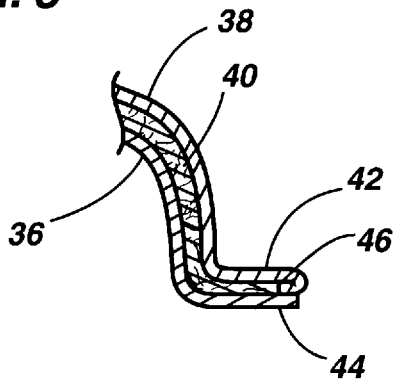
FIG. 3 is a fragmentary sectional view taken along line 3—3 of FIG. 1.
Figure 7:
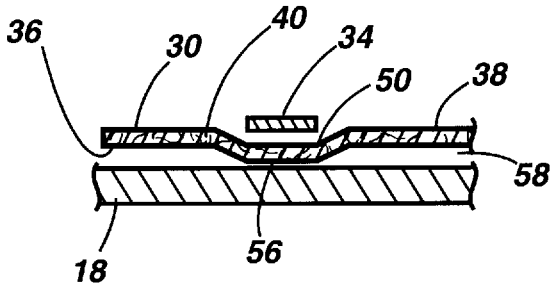
FIG. 7 is a fragmentary sectional view taken along line 7—7 of FIG. 1.

Three particular features are illustrated in FIGS. 2, 3 and 7 to be described herein. The first is in FIG. 3 where the outer or larger metal sheet 38 includes a transversely extending flange 42 which extends approximately co-extensively with a similar flange 44 on the innermost or smaller sheet 36. Strengthening flanges 42, 44 serve the purpose of rigidifying the structure of the composite insulating part 28, 30 such that they maintain their shapes against minor impacts and the like during assembly and disassembly as necessary in normal operations.

It will also be observed in FIG. 3 that flange 42 is folded back on itself to provide a spacer element 46 which fits between flanges 42 and 44 to minimize the crushing of insulating layer 40 during normal operations. It will be perfectly obvious to those in the field of heat transfer that crushing an insulation layer between the two metallic surfaces tends to minimize the heat barrier desirable.

Spacer mechanisms other than folded flange 46 are certainly within the concept of this invention but the folded back spacer element illustrated in FIG. 3 is preferred.

In order to hold the metallic elements 36, 38 in proper alignment so they do not separate, in the preferred embodiment, spot welds are applied in the flange area 42, 44. No doubt other ways to bond or secure the metallic sheets together may be conceived by those having ordinary skill in the art and such are within the inventive concept herein.

Looking to FIGS. 2 and 7 will be observed that a strap 34 extends completely around the exterior periphery of the insulation parts 28, 30 to hold them properly in place. The ends are joined together by a buckle 48 or an equivalent mechanism.

In order to prevent relative movement between parts 28, 30 longitudinally along leg 38, a depression or indented channel 50 is provided at each end of each insulating unit so that the clamp or strap 34 can fit down into the channel and prevent sideways movement by either part 28 and 30.

A further means for preventing relative movement between the insulation parts is illustrated in FIG. 2 where slots 52, 54 are cut through flanges 42, 44 to accommodate a smooth outer surface for the strap 34.

The indented channel 50 provides another feature which is best illustrated in FIG. 7. It is that the relatively narrow indented strip 56 of the smaller metallic sheet 36 is in direct contact with the surface of leg 18. The remainder of sheet 36 bridging between the end indentations does not contact leg 18. This minimizes heat transfer by conduction. The indentation 50 spaces most of the bridging portion of the insulating part between indentations and provides an insulating air gap 58 to assist in the minimization of heat transfer from the surface of leg 18 to parts 28, 30.

Having thus described the invention in its preferred embodiments it will be clear to those of ordinary skill in the art that modifications may be made to the structure without departing from the spirit of the invention. It is not intended that the language used to describe the same nor the drawings used for illustrative purposes be limiting on the invention rather it is intended that the invention be limited only by the scope of the appended claims.

We claim:

1. A heat shield for encompassing a hot pipe to minimize radiation from the pipes comprising:

two parts which together are configured to conform to the general exterior shape of the pipe and when operatively mounted formings a tube with said pipe within said tube and surrounded by said shield;

each part includes a larger metallic layer joined to a smaller metallic layer, said layers being spaced apart, said space between said metallic layers including a layer of heat insulation, and wherein in operative position each said smaller metallic layer is located closer to said pipe than said larger metallic layer;

one of said metallic layers of each part including a flange extending radially of said tube; and a spacer between said metallic layers to minimize crushing of said heat insulation layer, said spacer comprising a part of said flange folded back on itself to lie between said metallic layers.

2. The shield of claim 1 including a clamp to hold said parts together and in operative position around said pipe.

3. The shield of claim 1 wherein said metallic layer has a transversely extending flange and said folded part of said one of said flanges lies between the metallic layers at their periphery.

4. The shield of claim 3 including a spot weld at said flanges to join said metallic layer together.

5. The shield of claim 4 wherein said clamp comprises a flexible strap encircling the exterior of said two parts.

6. The shield of claim 5 including an indented channel in a larger metallic layer to accommodate said strap and thereby prevent relative movement of said parts.

7. The shield of claim 6 including mating slots in each flange to accommodate said strap and thereby prevent relative movement between said parts.

8. The shield of claim 5 including mating slots in each flange to accommodate said strap and thereby prevent relative movement between said parts.

9. The shield of claim 7 wherein said heat insulation comprises a layer of fibers selected from the group consisting of fiber glass, basalt mineral, and ceramic fibers and mixtures thereof.

10. The shield of claim 9 wherein said metallic layers are selected from a group consisting of aluminum foil and stainless steel foil.

11. The shield of claim 1 wherein said metallic layers are selected from a group consisting of aluminum foil and stainless steel foil.

12. The shield of claim 1 wherein said heat insulation comprises a layer of fibers selected from the group consisting of fiber glass, basalt mineral, and ceramic fibers and mixtures thereof.

13. The shield of claim 1 including a clamp to hold said parts together and in operative position around said pipe.

14. The shield of claim 13 wherein said clamp comprises a flexible strap encircling the exterior of said two parts.

15. The shield of claim 14 wherein said metallic layers each has a transversely extending flange and said folded part of said one of said flanges lies between the metallic layers.

16. The shield of claim 1 including an indented channel in a larger metalic layer to accommodate said strap and thereby prevent relative movement of said parts.

17. The shield of claim 1 including mating slots in each flange to accommodate said strap and thereby prevent relative movement between said parts.

* * * * *